US005243741A

United States Patent [19]

Fudaki et al.

[11] Patent Number: 5,243,741

[45] Date of Patent: Sep. 14, 1993

[54] BUCKLE

[75] Inventors: Tsutomu Fudaki, Kurobe; Ryukichi Murai, Toyama, both of Japan

[73] Assignee: Yoshida Kogyo K. K., Tokyo, Japan

[21] Appl. No.: 981,483

[22] Filed: Nov. 25, 1992

[30] Foreign Application Priority Data

Nov. 29, 1991 [JP] Japan ..... 3-106058[U]
Jan. 23, 1992 [JP] Japan ..... 4-006887[U]

[51] Int. Cl.[5] ..... A44B 11/00
[52] U.S. Cl. ..... 24/200; 24/197
[58] Field of Search ..... 24/200, 197, 198, 199, 24/196, 169; 297/476

[56] References Cited

U.S. PATENT DOCUMENTS 157,772 12/1874 Tyson ..... 24/169
4,171,555 10/1979 Bakker et al. ..... 24/200
4,525,901 7/1985 Krauss ..... 24/197
4,571,783 2/1986 Kasai ..... 24/200
4,637,099 1/1987 Kasai ..... 24/200
4,843,689 7/1989 Fildan ..... 24/200

FOREIGN PATENT DOCUMENTS 903051 8/1962 United Kingdom .
2153000 8/1985 United Kingdom .

*Primary Examiner*—Victor N. Sakran
*Attorney, Agent, or Firm*—Hill, Steadman & Simpson

[57] ABSTRACT

A buckle comprises a locking crossbar connected at its ends to respective ends of a pair of parallel side bars and a wrapping crossbar disposed in parallel spaced relation to the locking crossbar and connected at its ends with the side bars at their respective intermediate positions. The wrapping crossbar has a pair of juxtaposed sharp projecting ridges each extending longitudinally thereof; one projecting ridge being provided on the upper surface of the wrapping crossbar and the other on that side of the wrapping crossbar which is remote from the locking crossbar for increased frictional resistance of the belt to be inserted through the buckle.

5 Claims, 5 Drawing Sheets

BUCKLE

BACKGROUND OF THE INVENTION

1. Field of the Invention

The present invention relates to a buckle made of synthetic resin or metal and used on garments, baggages, sporting gears and so on.

2. Description of the Related Act

A typical example of this buckle is disclosed in Japanese Utility Model Publication No. 63-35638. This conventional buckle comprises a pair of opposed side bars, a locking crossbar connected at its ends to the respective ends of the side bars and a wrapping crossbar disposed in parallel spaced relation to the locking crossbar and connected at its ends with the side bars at their respective intermediate positions. The wrapping crossbar are in the cross-section of a pair of upper and lower semicircles integrally joined together bottom to bottom in staggered relation. Since joined in staggered relation, each of the upper and lower semicircles makes its one edge protrude beyond the relevant edge of the other semicircle. These protuberant edges are intended to function to retain a belt wrapped around the wrapping crossbar. The wrapping crossbar and locking crossbar are spaced from each other by a distance greater than the thickness of the belt to be used on the buckle. The locking crossbar has a locking corner formed on its lower side. The belt passes beneath the locking cross bar, between the locking cross bar and the wrapping crossbar, is wrapped around the wrapping crossbar and then returns beneath the locking crossbar.

Another example is disclosed in Japanese Utility Model Laid-open Publication No. 63-41206. The second conventional buckle is generally similar to the first conventional buckle. The major difference is that an additional locking crossbar is provided just below the wrapping bar in order to provide increased frictional resistance between the belt and the buckle.

In the first type of buckle, since the distance between the wrapping crossbar and the locking crossbar is formed much larger than the thickness of the belt to be used on the buckle, that part of the belt running between both crossbars slants obtusely so that the belt is inclined to slip on the locking edge of the locking bar, in other words, the locking crossbar cannot accomplish enough belt-locking effect.

Since the second type of buckle has the additional locking bar provided below the wrapping bar, the construction is the more complex and assemblage is the more difficult. Furthermore, it is the more difficult to insert the belt through the buckle for the same token.

SUMMARY OF THE INVENTION

With the foregoing difficulties in view, it is therefore an object of the present invention to provide a buckle which ensures that a belt to be fastened retentively thereto, and which is simple in construction, thus being easy in assemblage and in inserting the belt therethrough.

According to one aspect of the present invention, there is provided a buckle comprising a pair of opposed side bars, a locking crossbar connected at its ends to the respective ends of the side bars and a wrapping crossbar disposed in parallel spaced relation to the locking crossbar and connected at its ends with the side bars at their respective intermediate positions, the wrapping crossbar having a pair of juxtaposed sharp projecting ridges each extending longitudinally thereof, one projecting ridge being provided on the upper surface of the wrapping crossbar and the other on that side of the wrapping crossbar which is remote from the locking crossbar, the locking crossbar having a locking surface on its lowermost end which is lower than the lowermost end of the wrapping crossbar.

According to another aspect of the present invention, there is provided a buckle comprising a pair of opposed side bars, a locking crossbar connected at its ends to the respective ends of the side bars and a wrapping crossbar disposed in parallel spaced relation to the locking crossbar and connected at its ends with the side bars at their respective intermediate positions, the wrapping crossbar having a pair of opposed sharp projecting ledges each extending longitudinally thereof, one facing the locking crossbar and the other facing in opposition to the locking crossbar; the locking crossbar having at its distal end an upper locking corner and a lower locking corner; the wrapping crossbar being disposed upwardly of the the locking crossbar and being overlapped to the locking cross bar at least at their respective tips.

Many other advantages and features of the present invention will become manifest to those versed in the art upon making reference to the detail description and the accompanying sheets of drawings in which preferred structural embodiments incorporating the principles of the present invention are shown by way of illustrative example.

DETAILED DESCRIPTION

Figure 1:
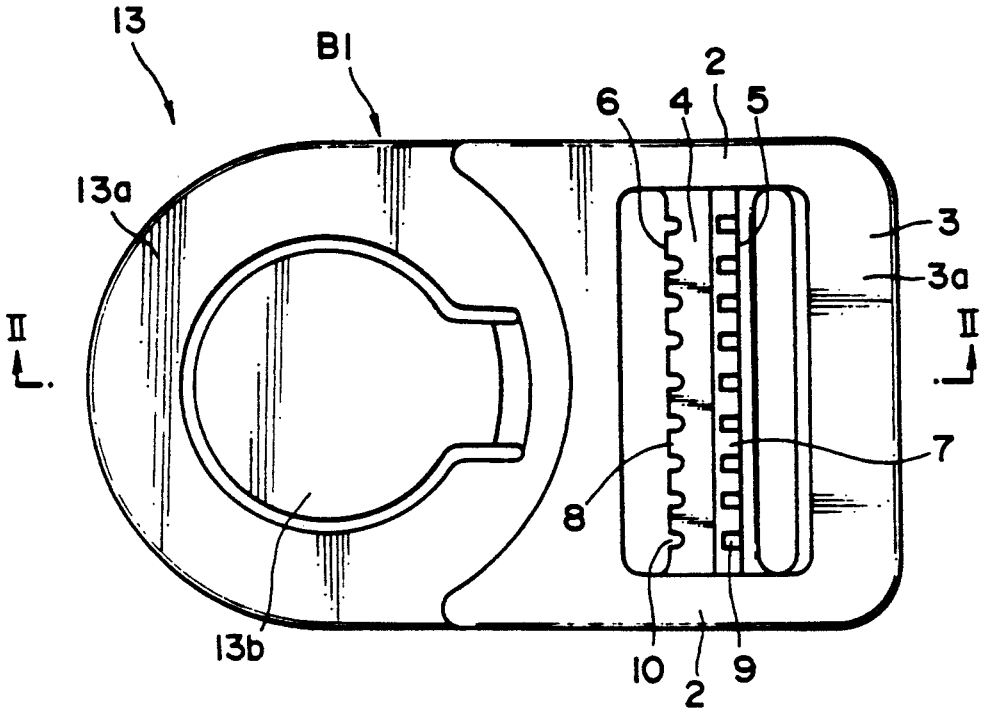
FIG. 1 is a front view of a male member of a buckle of the so-called plug-and-socket type in which the present invention is embodied.

The present invention will be described in conjunction with several embodiments illustrated in the drawings attached hereto.

Figure 2:
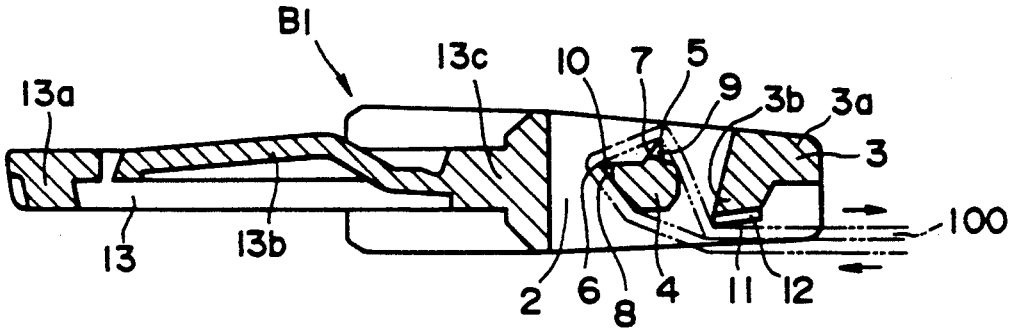
FIG. 2 is a central longitudinal cross-section of the male member of the buckle of FIG. 1.

FIGS. 1 and 2 show a male member or a plug member B1 of a buckle of the so-called plug-and-socket type according to the first embodiment of the present invention. This type of buckle includes, in addition to the male member B1, a female member or a socket member (not shown) adapted to come into coupling engagement with the male member B1. Since the construction of the female member is well known in this art, further detailed explanation thereof has been omitted for brevity's sake.

As shown in FIGS. 1 and 2, the male member B1 of the buckle comprises a pair of opposed side bars 2, 2, a locking crossbar 3 connected at its ends to the respective ends of the side bars 2, 2 and a wrapping crossbar 4 disposed in parallel spaced relation to the locking crossbar 3 and connected at its ends with the side bars 2, 2 at their respective intermediate positions. The male member B1 further includes a plug portion 13 provided at the opposite ends of the side bars 2, 2 so as to extend therefrom in the general plane of the male member B1. The plug portion 13 includes a plug base 13*c*, an annular rim 13*a* provided integrally on the plug base 13*c* and a resilient center flap 13*b* also provided integrally on the plug base 13*c* so as to extend therefrom and surrounded by the annular rim 13*a*. The resilient central flap 13*b* is normally urged by its own resiliency so as to come slightly out of the surrounding annular rim 13*b*. The plug portion 13 is inserted into a female member (not shown) against the resiliency of the resilient central flap 13*b*. As soon as the plug portion 13 is fully inserted therein, the resilient center flap 13*b* restores into the original position under its own resiliency, thus coming into engagement with catching means of the female member.

Importantly, as better shown in FIG. 2, the wrapping crossbar 4 has a pair of juxtaposed sharp projecting ridges 5, 6 each extending longitudinally of the wrapping crossbar 4. A first projecting ridge 5 is provided on the upper surface of the wrapping crossbar 4, while a second projecting ridge 5 is provided on that side of the wrapping crossbar 4 which is remote from the locking crossbar 3. Either of the projecting ridges 6, 5 has a pluality of notches 9, 10, respectively, formed at intervals longitudinally thereof in such a way to run across the projecting ridges 4, 5.

As better shown in FIG. 2, the locking crossbar 3 is of inverted L-shaped cross-section and comprises a horizontal portion 3*a* extending along the upper edges of the side bars 2, 2 and a slope portion 3*b* extending inwardly downward from the inner end of the horizontal portion 3*a*. The lowermost end of the slope portion 3*b* of the locking crossbar 3 is lower than that of the wrapping crossbar 4. The lowermost end of the slope portion 3*b* constitutes a bottom locking surface 11. For increased frictional resistance, the bottom locking surface 11 has a plurality of indentations 12 formed at intervals longitudinally thereof so as to run across the bottom locking surface 11.

As viewed perpendicularly of the general plane of the buckle male member B1, the locking crossbar 3 and the wrapping crossbar 4 are spaced from each other by a distance greater than the thickness of a belt 100 to be used on the male member B1. The belt 100 passes beneath the bottom locking surface 11 of the locking crossbar 3, then wraps around the wrapping crossbar 4 and passes between the locking crossbar 3 and the wrapping crossbar 4, and eventually returns to beneath the locking crossbar 3, as indicated by phantom lines in FIG. 2.

Figure 3:
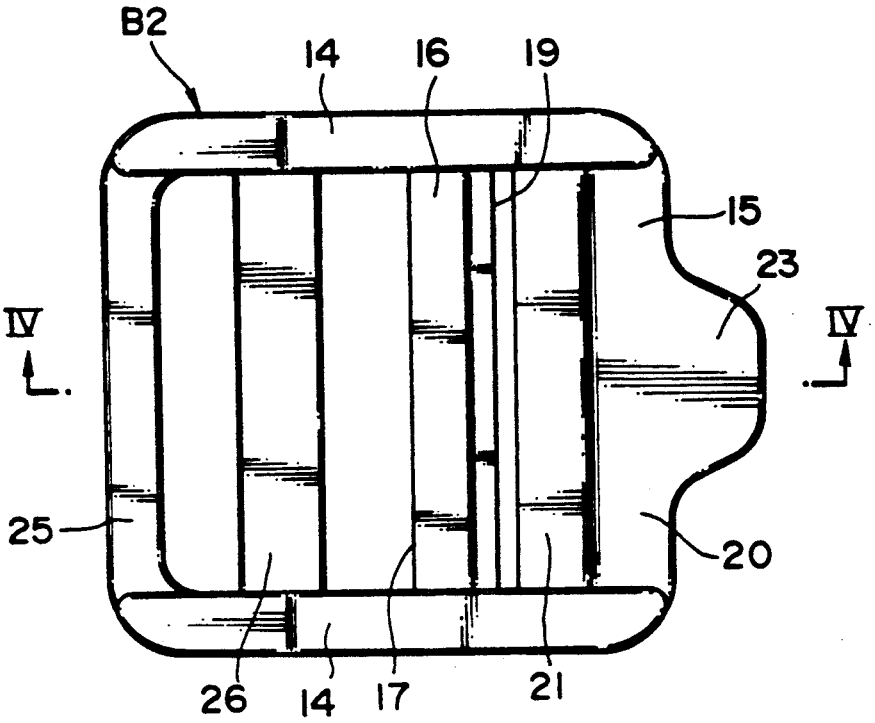
FIG. 3 is a front elevation of a buckle of the so-called wrapping type in which the present invention is embodied.
Figure 4:
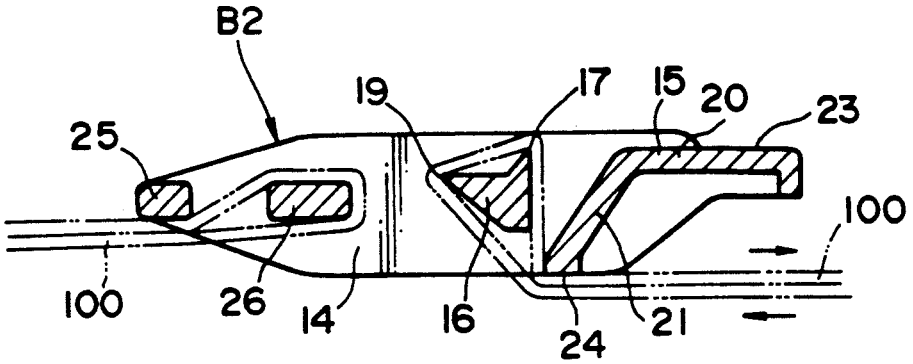
FIG. 4 is a central longitudinal cross-section of the buckle of FIG. 3.

FIGS. 3 and 4 show a buckle B2 of the so-called wrapping type according to the second embodiment of the present invention. Similarly to the buckle B1, the buckle B2 comprises a pair of opposed side bars 14, 14, a locking crossbar 15 connected at its ends to the respective ends of the side bars 14, 14 and a wrapping crossbar 16 disposed in parallel spaced relation to the locking crossbar 15 and connected at its ends with the side bars 14, 14 at their respective intermediate positions.

Instead of the plug portion 13 of the buckle B1, the buckle B2 further includes an end crossbar 25 connected at its opposed ends to the respective other ends of the side bars 14, 14, to thereby define a rectangular buckle frame with the opposed side bars 14, 14 and the locking crossbar 15. The buckle B2 still further includes an intermediate crossbar 26 connected at its end to the side bars 14, 14 at their intermediate positions. The intermediate crossbar 26 is interposed between the end crossbar 25 and the wrapping crossbar 16 and is used to wrap one end of the belt 100 therearound and permanently fasten the belt 100 thereto for example by stitching or rivetting.

The wrapping crossbar 16 has a pair of juxtaposed sharp projecting ridges 17, 19 each extending longitudinally thereof. A first projecting ridge 17 is provided on the upper surface of the wrapping crossbar 16, while a second projecting ridge 19 is provided on the side remote from the locking crossbar 15. Unlike the projecting ridges 5, 6 of the buckle B1, the projecting ridges 17, 19 of the buckle B2 have no notches, as clearly seen in FIG. 4.

As better shown in FIG. 4, the locking crossbar 15 is of substantially inverted L-shaped cross-section and comprises a horizontal portion 20 extending substantially along the upper edges of the side bars 14, 14 and a slope portion 21 extending inwardly downward from the inner end of the horizontal portion 20. The lowermost end of the slope portion 21 of the locking crossbar 15 is lower than the lowermost end of the wrapping crossbar 16. The lowermost end of the slope portion 21 constitutes a bottom locking surface 24. The bottom locking surface 24 of the locking crossbar 20 has no indentation. To make up for the loss of frictional resistance due to there being no notch nor indentation in the wrapping crossbar 16 and locking crossbar 20, the distance between the wrapping bar 16 and the locking crossbar 20 as measured along the general plane of the buckle B2 is set to be substantially equal to the thickness of the belt 100 so that the belt 100 passing beneath the bottom locking surface 24 of the locking crossbar 20, wrapping around the wrapping crossbar 16, then passing between the locking crossbar 20 and eventually returning to beneath the locking crossbar 20 will assume the posture as indicated by phantom lines in FIG. 4. A tab 23 is provided as an integral extension extending outwardly from the horizontal portion 20 of the locking crossbar 15 to facilitate manipulation of the buckle B2.

Figure 5:
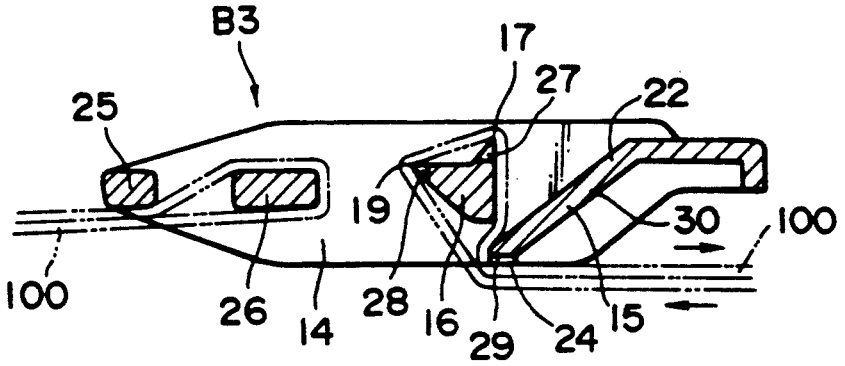
FIG. 5 is a view similar to FIG. 4 but showing another embodiment of the present invention.

FIG. 5 shows a buckle B3 according to a third embodiment of the present invention which is substantially identical with the buckle B2 according to the second embodiment except for the following two features.

The slope portion 30 of the locking crossbar 15 projects further inward of the buckle B3 so as to partly comes in overlapping relation to the wrapping crossbar 16 whereby the tip of the slope portion 30 wedges into that part of the belt 100 passing by the lowermost end of the wrapping crossbar 16 and extending toward the bottom locking surface 24 of the locking crossbar 15.

The second difference is that each of the projecting ridges 17, 19 has a plurality of notches 27, 28 respectively, formed at intervals longitudinally thereof in such a way to run across the projecting ridges 17, 19 and the bottom locking surface 21 of the locking crossbar 15 has a plurality of indentations 24 formed at intervals longitudinally thereof so as to run across the bottom locking surface 24. The slope portion 30 wedging into the belt 100 for one thing and the notches 27, 28 and indentations 29 being formed in the wrapping crossbar 16 and the locking crossbar 15, respectively, for another are coupled together to thus ensure that the belt 100 is held between the wrapping crossbar 16 and the locking crossbar 15 further retentively.

Figure 6:
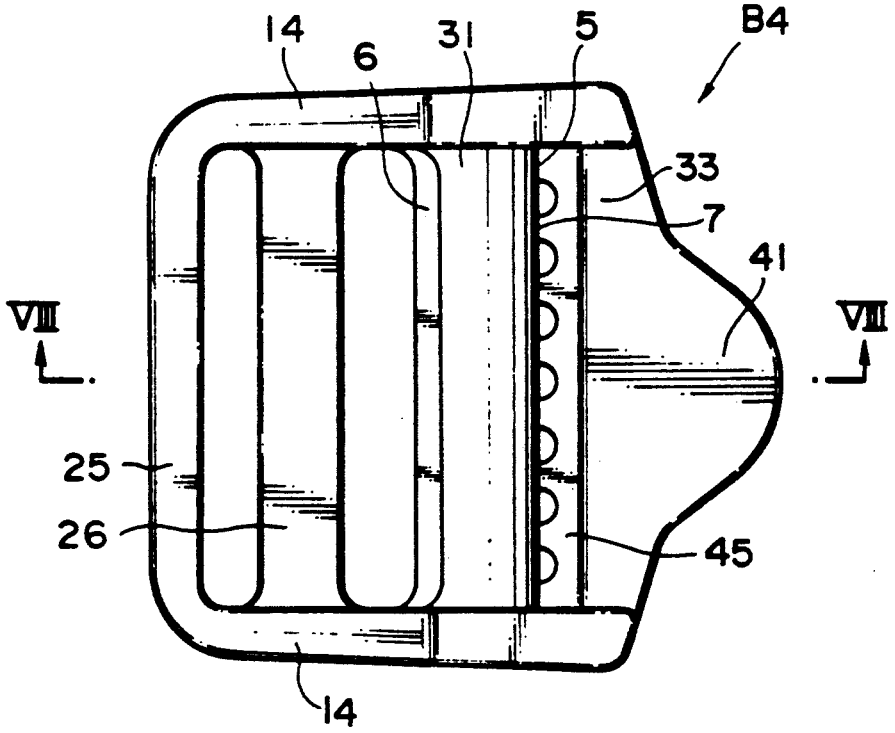
FIG. 6 is a view similar to FIG. 3 but showing still another embodiment of the present invention
Figure 7:
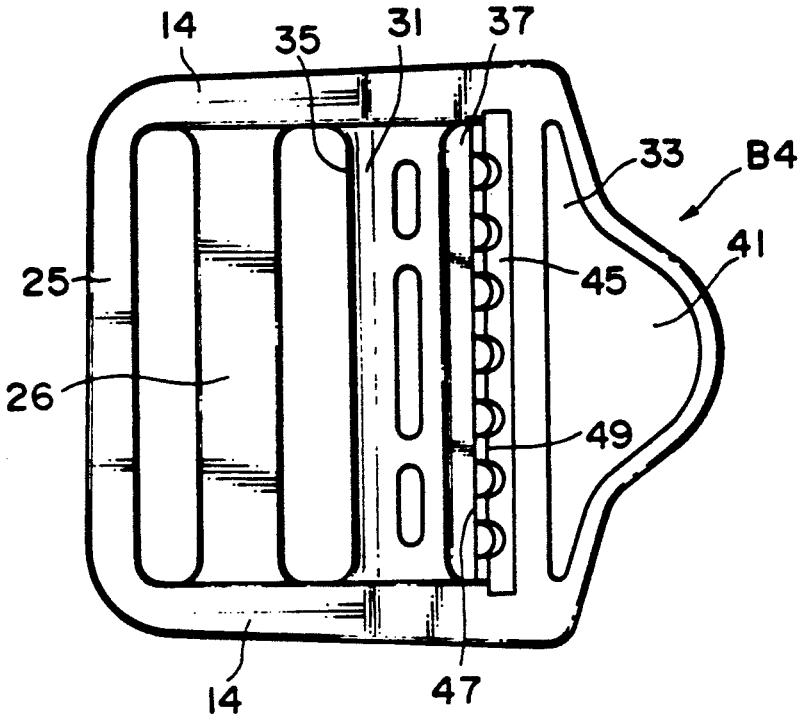
FIG. 7 is a rear view of the buckle of FIG. 6.
Figure 8:
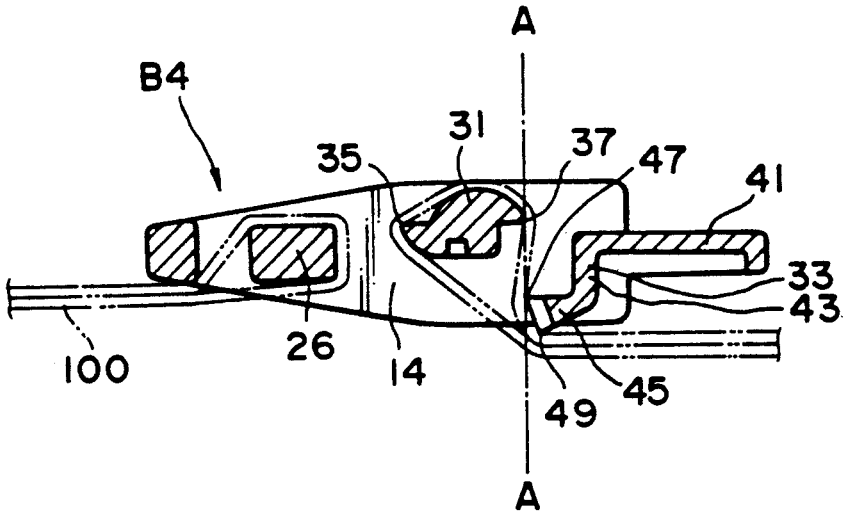
FIG. 8 is a cross-sectional view taken on line VIII—VIII of FIG. 6.

FIGS. 6 through 8 show a buckle B4 according to the fourth embodiment of the present invention. The buckle B4 is substantially identical with the buckle B3 except for the cross-sectional shapes of the wrapping crossbar 31 and the locking crossbar 33. As better shown in FIG. 8, the wrapping crossbar is substantially in the cross-sectional shape of a pair of semicircles joined together bottom to bottom in staggered relation to thus provide a pair of opposed sharp ledges; that is, an overhanging edge 37 facing the locking crossbar 33 and a projecting ledge 35 facing in the opposite direction to the locking crossbar 33 or facing the intermediate crossbar 26.

The locking crossbar 33 is substantially of L-shaped cross-section and comprises a vertical portion 43 and a flared horizontal portion 45 integrally provided on the lower end of the vertical portion 43. The horizontal portion 45 is diverged toward its distal end to thus terminate in a pair of upper and lower locking corners 47, 49 each of which corners assume an acute interior angle. The upper locking corner 47 projects more inward or more close to the center of the buckle B4 than the lower locking corner 49. It is to be noted that the upper locking corner 47 is right on an imaginary plane A—A running through the tip of the overhanging ledge 35 perpendicularly to the general plane of the buckle B4, which means that the locking crossbar 33 is overlapped to the wrapping crossbar 31 at the respective tips.

A tab 41 is integrally provided on the upper edge of the vertical portion 43 so as to extend outward therefrom in the general plane of the buckle B4. The tab 41 facilitates grasping and handling the buckle B4.

Figure 9:
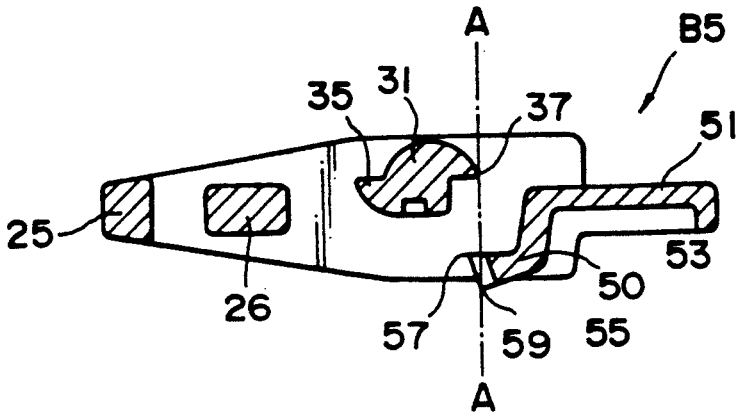
FIG. 9 is a view similar to FIG. 8 but showing yet another embodiment of the present invention.

FIG. 9 shows a buckle B 5 according to the fifth embodiment of the present invention. The buckle B5 is substantially identical with the buckle B4 except that the upper locking corner 57 of the locking crossbar 50 projects slightly inward of the imaginary plane A—A, while the lower locking corner 59 falls just on the imaginary plane A—A.

Figure 10:
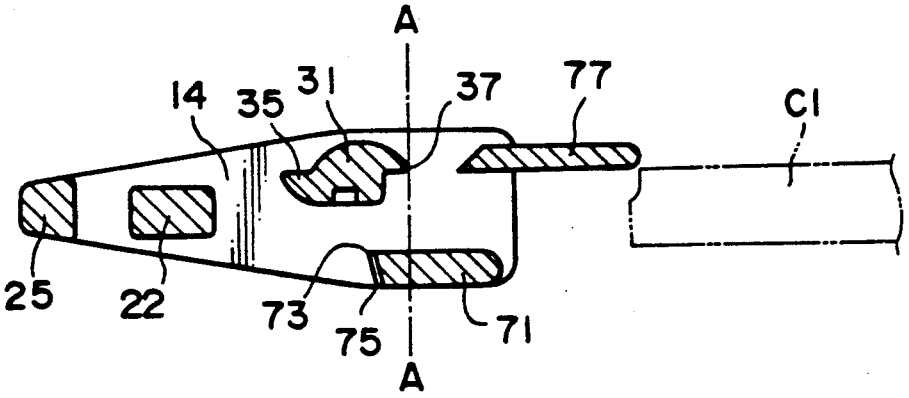
FIG. 10 is a view similar to FIG. 9 but showing still another embodiment of the present invention.

FIG. 10 shows a buckle B6 according to the sixth embodiment of the present invention. The buckle B6 is substantially identical with the buckle B4 and B5 with the exception that the locking crossbar 71 is in the shape of a flat panel having a uniform thickness over its full area whose lower surface is coplanar with the lower edges of the side bars 14, 14, and that a separate flat plate tab 77 is provided adjacent to the upper edge of the side bars 14, 14 so as to extend outward therealong. The upper locking corner 73 of the panel-like locking crossbar 71 has an acute interior angle while the lower locking corner 75 an obtuse interior angle. Both locking corners 73, 75 project further deeply inward of the imaginary line A—A, which means that the wrapping crossbar 31 is overlapped to the locking crossbar 71 at considerable area. A core C1 used in molding the buckle B 6 is indicated in phantom lines in FIG. 10. Partly because the both locking corners 73, 75 project further inward and partly because the widened lower surface of the panel-like crossbar 71 provides increased frictional resistance on the belt (not shown) to lie therebeneath, the belt can be fastened more retentively and is kept from slipping off the buckle.

With the constructions as set forth hereinabove, the buckle can fasten the belt thereon retentively to thus fully prevent the belt from slipping thereoff.

Furthermore, the construction of the buckle is so simple that the assembling operation thereof and the belt-inserting operation therethrough are very easy.

Obviously, the skilled person would realize that various modifications and variations of the present invention are possible in the light of the above teaching. It is therefore to be understood that within the scope of the appended claims the invention may be practiced otherwise than as specifically described, and that the invention is not limited to the embodiments described above in detail.

What is claimed is:

1. A buckle comprising a pair of opposed side bars, a locking crossbar connected at its ends to the respective ends of the side bars and a wrapping crossbar disposed in parallel spaced relation to the locking crossbar and connected at its ends with the side bars at their respective intermediate positions, the wrapping crossbar having a pair of juxtaposed sharp projecting ridges each extending longitudinally thereof, one projecting ridge being provided on the upper surface of the wrapping crossbar and the other on that side of the wrapping crossbar which is remote from the locking crossbar, the locking crossbar having a locking surface on its lowermost end which is lower than the lowermost end of the wrapping crossbar.

2. A buckle according to claim 1, each projecting ridge having a plurality of notches formed at intervals longitudinally thereof, each notch running across the projecting ridge.

3. A buckle comprising a pair of opposed side bars, a locking crossbar connected at its ends to the respective ends of the side bars and a wrapping crossbar disposed in parallel spaced relation to the locking crossbar and connected at its ends with the side bars at their respective intermediate positions, the wrapping crossbar having a pair of opposed sharp projecting ledges each extending longitudinally thereof, one facing the locking crossbar and the other facing in opposition to the locking crossbar; the locking crossbar having at its distal end an upper locking corner and a lower locking corner; the wrapping crossbar being disposed upwardly of the locking crossbar and being overlapped to the locking cross bar at least at their respective tips.

4. A buckle according to claim 3, the upper locking corner protruding more inward than the lower locking corner.

5. A buckle according to claim 3, the locking crossbar being diverged toward its distal end, both of the upper and lower locking corners having an interior acute angle.

* * * * *